US006763765B2

(12) United States Patent
Crowson

(10) Patent No.: US 6,763,765 B2
(45) Date of Patent: Jul. 20, 2004

(54) BREAK-AWAY GAS CHECK FOR MUZZLE-LOADING FIREARMS

(76) Inventor: Harold Crowson, c/o Big Bore Express, 16345 Midway Rd., Nampa, ID (US) 38651

( * ) Notice: Subject to any disclaimer, the term of this patent is extended or adjusted under 35 U.S.C. 154(b) by 0 days.

(21) Appl. No.: 10/259,374

(22) Filed: Sep. 27, 2002

(65) Prior Publication Data

US 2003/0056416 A1 Mar. 27, 2003

Related U.S. Application Data

(60) Provisional application No. 60/325,530, filed on Sep. 27, 2001.

(51) Int. Cl.[7] ..... F42B 14/06

(52) U.S. Cl. ..... 102/522; 42/51

(58) Field of Search ..... 42/51, 76.1, 77, 42/78; 102/522, 532, 520, 526, 527, 389, 517

(56) References Cited

U.S. PATENT DOCUMENTS

| | | | | |
|---|---|---|---|---|
| 1,410 A | * | 11/1839 | Lindner | 177/150 |
| 34,590 A | | 4/1862 | James | |
| 35,273 A | | 5/1862 | Williams | |
| 36,879 A | | 11/1862 | Bird | |
| 39,112 A | | 7/1863 | Berney | |
| 41,668 A | | 2/1864 | Absterdam | |
| 43,017 A | | 6/1864 | Ganster | |
| 44,492 A | * | 9/1864 | Williams | 102/525 |
| RE6,027 E | | 8/1874 | Parrott | |
| 384,574 A | | 6/1888 | Hawley | |
| 405,690 A | | 6/1889 | Ball | |
| 1,044,360 A | | 11/1912 | DuBois | |
| 2,389,846 A | | 11/1945 | Ericson | 102/93 |
| 2,911,911 A | | 11/1959 | White | 102/532 |
| 2,983,225 A | | 5/1961 | Walker | 102/93 |

(List continued on next page.)

FOREIGN PATENT DOCUMENTS

| | | | |
|---|---|---|---|
| AT | 35741 | 12/1908 | 102/520 |
| CH | 488990 | 5/1970 | 102/525 |
| DE | 2606135 | 8/1977 | 102/520 |
| DE | 4403725 A1 * | 8/1994 | F42B/14/06 |
| FR | 23676 | 12/1921 | |
| FR | 618600 | 3/1927 | 102/520 |
| GB | 1667 | of 1868 | 102/525 |
| IT | 289179 | 8/1935 | 102/525 |
| IT | 299613 | 11/1936 | 102/525 |

OTHER PUBLICATIONS

English translation of Italy 289,179 (Breda) (front page only).

*Primary Examiner*—Michael J. Carone
*Assistant Examiner*—Denise. J. Buckley
(74) *Attorney, Agent, or Firm*—Pedersen & Co., PLLC; Ken J. Pedersen; Barbara S. Pedersen

(57) ABSTRACT

A gas check member for use in muzzle-loading firearms is provided. The invented gas check is designed to conveniently, frictionally attach rearward of a sub-caliber bullet to maximize the efficiency of such firearms. The diameter of the gas check preferably exceeds that of the bore slightly to prevent scoring and deformation of the bullet during loading, to hold the projectile in place within the barrel and to prevent moisture from contacting the powder when in place. Upon firing, the gas check minimizes the escape of propellant gases around the projectile and imparts a large, uniformly distributed forward thrust to the bullet to maximize the ballistic qualities of the shot. The design incorporates an unstable connection between inner and outer members that, upon firing, fractures to facilitate quick and reliable detachment of the outer member from the bullet. Detachment occurs to prevent interference with the trajectory of the bullet upon exit from the barrel.

16 Claims, 5 Drawing Sheets

U.S. PATENT DOCUMENTS

| | | | | | |
|---|---|---|---|---|---|
| 3,164,092 | A | * | 1/1965 | Reed et al. | 102/522 |
| 3,374,740 | A | * | 3/1968 | Voda | 102/370 |
| 3,427,648 | A | * | 2/1969 | Manning et al. | 102/523 |
| 3,714,900 | A | * | 2/1973 | Feldmann | 102/522 |
| 3,744,426 | A | | 7/1973 | Butler | 102/527 |
| 3,802,345 | A | * | 4/1974 | La Costa | 42/78 |
| 3,862,603 | A | * | 1/1975 | Kornblith et al. | 102/522 |
| 4,047,466 | A | | 9/1977 | Berman | 89/14 R |
| 4,175,493 | A | | 11/1979 | Daily | 102/532 |
| 4,384,529 | A | | 5/1983 | Burns et al. | 102/525 |
| 4,434,718 | A | | 3/1984 | Kopsch et al. | 102/522 |
| 4,450,770 | A | * | 5/1984 | Kirkendall et al. | 102/523 |
| 4,452,144 | A | * | 6/1984 | Maki | 102/453 |
| 4,549,488 | A | | 10/1985 | Hoffmann et al. | 102/522 |
| 4,587,905 | A | | 5/1986 | Maki | 102/532 |
| 4,782,759 | A | * | 11/1988 | Hawk | 102/450 |
| 4,884,508 | A | * | 12/1989 | Kruse et al. | 102/524 |
| H794 | H | * | 7/1990 | Telmo et al. | 102/527 |
| 4,947,752 | A | * | 8/1990 | Richert | 102/430 |
| 5,097,615 | A | | 3/1992 | Kearns | 42/90 |
| 5,150,909 | A | | 9/1992 | Fitzwater | 273/428 |
| 5,164,539 | A | * | 11/1992 | French | 102/520 |
| 5,347,932 | A | * | 9/1994 | Gardner et al. | 102/451 |
| 5,415,102 | A | * | 5/1995 | White | 102/522 |
| 5,458,064 | A | | 10/1995 | Kearns | 102/520 |
| 5,479,861 | A | * | 1/1996 | Kinchin | 102/439 |
| 5,621,187 | A | | 4/1997 | Kearns | 102/520 |
| 5,915,938 | A | | 6/1999 | Moore | 42/83 |
| 5,987,799 | A | | 11/1999 | Dedeaux et al. | 42/90 |
| 6,085,454 | A | * | 7/2000 | Caudle | 42/90 |
| 6,105,506 | A | | 8/2000 | Gangale | 102/439 |
| 6,161,482 | A | * | 12/2000 | Clark | 102/532 |
| 6,481,356 | B2 | * | 11/2002 | Gualandi | 102/439 |

* cited by examiner (DOVE-TAIL EXAGGERATED FOR ILLUSTRATIVE PURPOSES)

BREAK-AWAY GAS CHECK FOR MUZZLE-LOADING FIREARMS

This application claims priority of prior Provisional Application Serial No. 60/325,530, filed Sep. 27, 2001, entitled "Break Away Gas-Check for Muzzle Loading Firearms".

BACKGROUND OF THE INVENTION

1. Field of the Invention

This invention relates, in general, to the use of muzzle-loading firearms. More specifically, this invention relates to the design and manufacture of projectiles to be used in such firearms.

2. Related Art

To function most effectively, muzzle-loading firearms preferably involve the use of a bullet in conjunction with some type of wad or gas check member. Throughout the history of such firearms, various configurations that embrace this design principle have been utilized. The wad or gas check is used to secure the bullet properly within the bore without significant deformation of the bullet, and to prevent the escape of forward thrusting gases around the bullet upon firing the firearm. Prior to the use of wads or gas checks, a malleable lead bullet, with a diameter necessarily greater than that of the bore of the firearm, was ram-rodded down the barrel. In this manner, the bullet was frictionally secured in place over the powder charge and engaged with the rifling of the bore, but often malformed when being so placed.

The use of sabots or wrappers was later introduced to facilitate another mechanism of securing the bullet in place. These devices surround a sub-caliber bullet to engage the rifling and secure the bullet without requiring the deformation of a large diameter bullet. When the firearm is discharged the interaction between wrapper and rifling imparts spin to the bullet. C. T. James and A. Ball have obtained U.S. Pat. Nos. 34,950 and 405,690, respectively, for such wrapper-type devices.

D. D. Williams, U.S. Pat. No. 35,273, and G. P. Ganster, U.S. Pat. No. 43,017, have acquired patents for inventions in which the wad was directly attached to the bullet for use in muzzle-loading firearms.

Significant reductions in the efficiency of such firearms often result from destructive interactions between the bullet and bore. When wrappers are used to surround the bullet, the positioning of the wrapper between the bullet and bore may affect the ballistic qualities of the shot. In the case of large-diameter bullets, the scoring and deformation of the projectile that results from the loading process may affect the discharge of the bullet from the bore as well as the in-flight aerodynamics. Kearns, U.S. Pat. No. 5,458,064 provides a gas check member for use with sub-caliber bullets. The diameter of this gas check slightly exceeds that of the bore. The gas check is frictionally attached rearward of the bullet and is constructed of deformable, but durable, plastic. However, where the gas check member does not detach from the bullet, the velocity and accuracy of the shot may be significantly reduced.

Therefore, there is a need for a frictionally attached gas check for use in muzzle-loading firearms that is designed to quickly and reliably detach from the bullet upon firing.

SUMMARY OF THE INVENTION

The present invention provides a gas check member for use in muzzle-loading firearms. The gas check member is designed to participate in the loading and firing process such that the loading of such firearms is simple, fast, and effective.

In addition to serving its gas check function, the invented gas check member is designed to secure the bullet in place within the bore and prevent moisture from contacting the powder once the projectile is secured. All this must be accomplished simply and without interfering with the trajectory of the bullet upon firing.

The gas check member comprises a generally cylindrical element with a maximum diameter slightly exceeding that of the bore, which is preferably constructed of a resilient plastic material. The present invention is designed for use with a bullet. The diameter of the gas check member varies according to the diameter, or caliber, of the bullet and bore. The bullet typically comprises a solid cylindrical, ogive or blunted ogive element that tapers in the direction of its forward end and includes at its back end an engaging means. Such bullets are often constructed of lead or another suitable material with a maximum diameter slightly smaller than the bore. The gas check member is located rearward of the maximum diameter of the bullet where it is frictionally attached by the engaging means. Preferably, the gas check member does not surround the bullet.

Upon firing, the gas check member prevents rapidly expanding gases, produced by the ignition of the powder, from escaping around the bullet. These gases impart the necessary forward thrust to the projectile; therefore, minimizing the escape of these gases is beneficial to efficient discharge of the bullet from the barrel of the firearm. The gas check member is designed to corral these propellant gases and transmit a distributed force to the projectile that ejects the bullet from the barrel. A substantial portion of the invented gas check detaches from the bullet upon firing to avoid inhibiting the trajectory of the bullet after its exit from the barrel.

The mechanism of detachment involves the fracture of the gas check member at its forward end along a connective band between the engaging member and the outer skirt. The gas check is engineered to rupture along this annular disk under the force of the gases rushing towards the uncapped distal end of the barrel. Upon exiting the barrel, the skirt of the gas check separates from the bullet allowing the bullet to continue, unimpeded, toward the target.

DETAILED DESCRIPTION OF THE INVENTION

Referring to the Figures, several views of the preferred embodiment of the invented gas check member are presented. The gas check is designed for use in combination with a bullet, and is shown as such. This combination will herein be referred to as a projectile.

Figure 1:
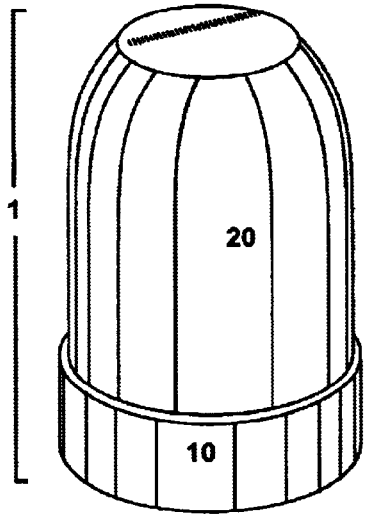
FIG. 1 is a perspective view of the preferred embodiment of the invented gas check united with a bullet of the preferred design.
Figure 2:
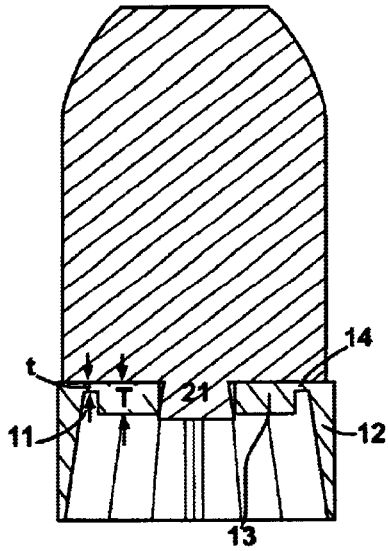
FIG. 2 is a cross-sectional view of the combined projectile of FIG. 1 demonstrating one basic configuration of the gas check.
Figure 2A:
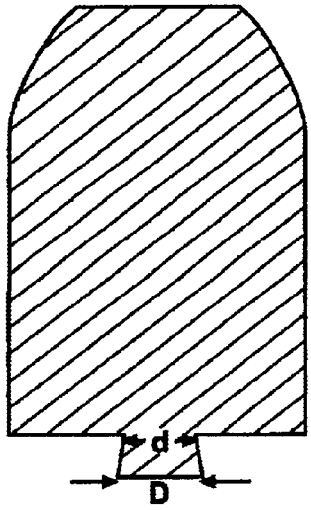
FIG. 2*a* is a cross-sectional view of one possible alternative to the preferred bullet configuration illustrated an exaggerated dove-tail stem.
Figure 4:
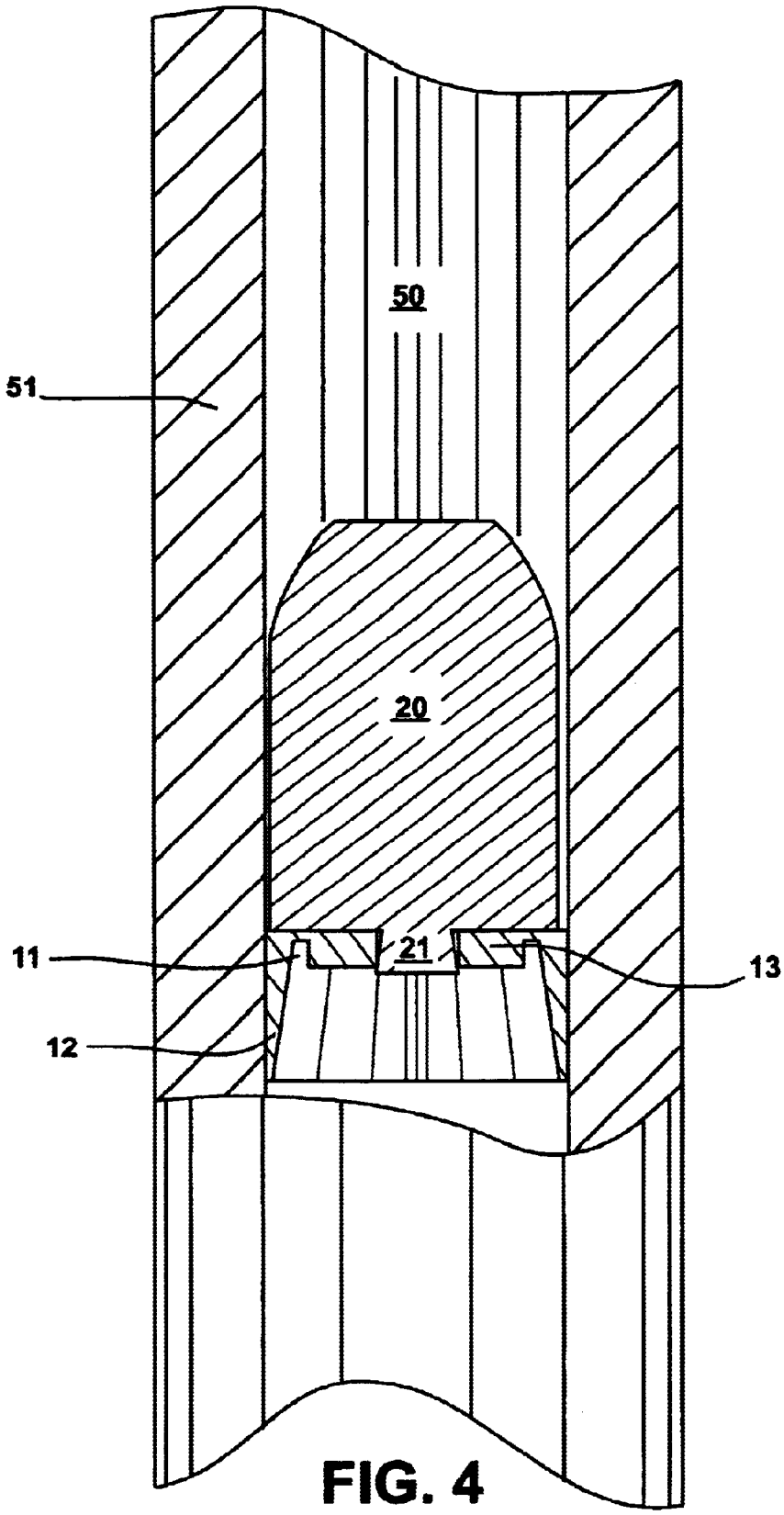
FIG. 4 is a cross-sectional view of the projectile and barrel, prior to firing, illustrating the positioning and fit of the gas check within the bore.

The invented gas check member 10 comprises a generally cylindrical element preferably constructed of a resilient plastic material and engineered to attach rearward of the maximum diameter of the bullet 20, as shown in FIGS. 1 and 2. The maximum diameter of the bullet is preferably slightly less than that of the bore, and the diameter of the gas check member exceeds that of both bullet and bore 50. This relationship is illustrated in FIG. 4. Bullets used in muzzle-loading firearms are typically composed of a suitable solid, but deformable, material such as lead, and exhibit a tapered cylindrical, ogive or blunted ogive design. The preferred bullet for use with the invented gas check includes a short stem 21 protruding backward along its central axis that provides the point of attachment for the gas check member. One alternative embodiment, for a more secure attachment, may provide a dove-tailed stem in which the diameter d at its proximal end is slightly smaller than the diameter D at its distal end, as shown in FIG. 2*a*. Still another alternative may provide a bullet with a small circular cavity depressed in its back end along the central axis for receiving an oversized stem-like engaging member.

Figure 3:
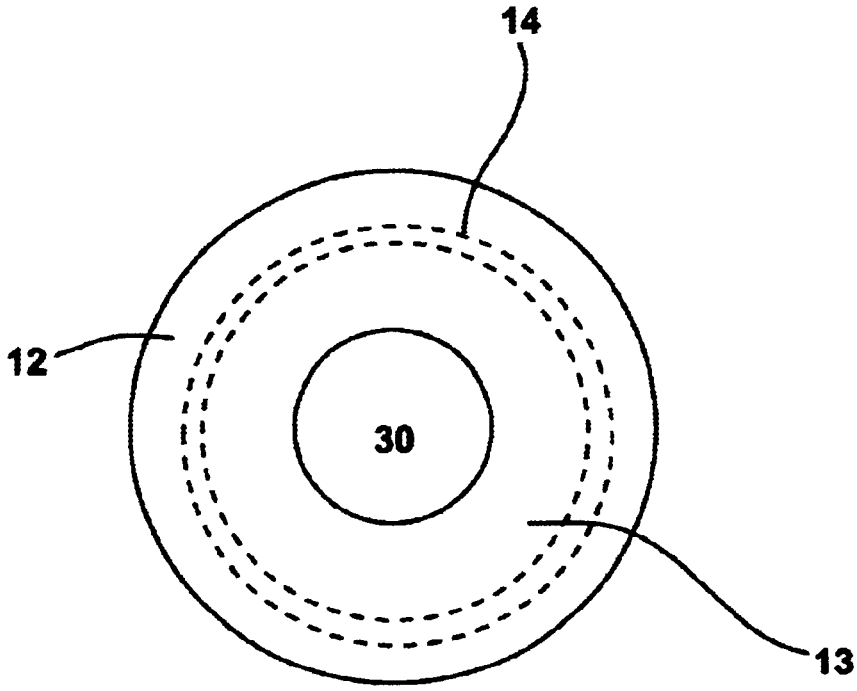
FIG. 3 is a bottom view of the preferred gas check showing the position of the thin connective band and the aperture.

The forward portion of the gas check member preferably includes an engaging member lying substantially within an outer wall which substantially resembles a skirt, as shown in FIG. 2. In the preferred embodiment, the engaging member comprises an inner ring 13 with a small aperture 30. The inner ring is connected to the skirt 12 by a connecting element. Preferably, this connecting element is a band 14 of plastic material which is substantially reduced in thickness relative to the engaging inner ring 13, as shown in FIGS. 2 and 3. The thickness t of the connecting element is preferably between ⅛ and ½ that of the thickness T of the engaging member, as shown in FIG. 2. Several alternatives to the thin connecting band 14 of the preferred embodiment are foreseeable so long as the skirt separates from the engaging member upon exit from the barrel. For example, the connecting element may comprise a band of material that has been significantly weakened by exposure to light, heat, mechanical, or other stress. In the preferred embodiment, the thickness of the inner ring 13 is greater than that of the band 14 to provide strength and additional surface area for contacting the bullet stem 21, and the diameter of the aperture is slightly smaller than the largest diameter of the bullet stem.

FIG. 2 demonstrates the preferred mechanism of attachment between bullet 20 and gas check 10. When the stem 21 is inserted into the aperture 30, the resilient material tolerates a slight enlargement of the aperture to permit a secure frictional attachment of bullet and gas check. One foreseeable alternative to this mechanism of attachment may comprise a slightly oversized, deformable plastic stem protruding from the forward end of the engaging member which is received within a depression in the back of the bullet. In this case, the engaging stem will be compressed slightly to frictionally secure the gas check to the bullet. Other alternative means are also possible. The attachment between bullet and gas check remains intact until exiting the barrel for the following reasons: to engage the rifling of the bore, to prevent moisture leakage from the barrel 51 onto the powder after the projectile 1 is in place and to prevent interference between bullet and bore 50 while loading. The usual positioning of the projectile 1 within the bore is shown in FIG. 4.

Figure 5:
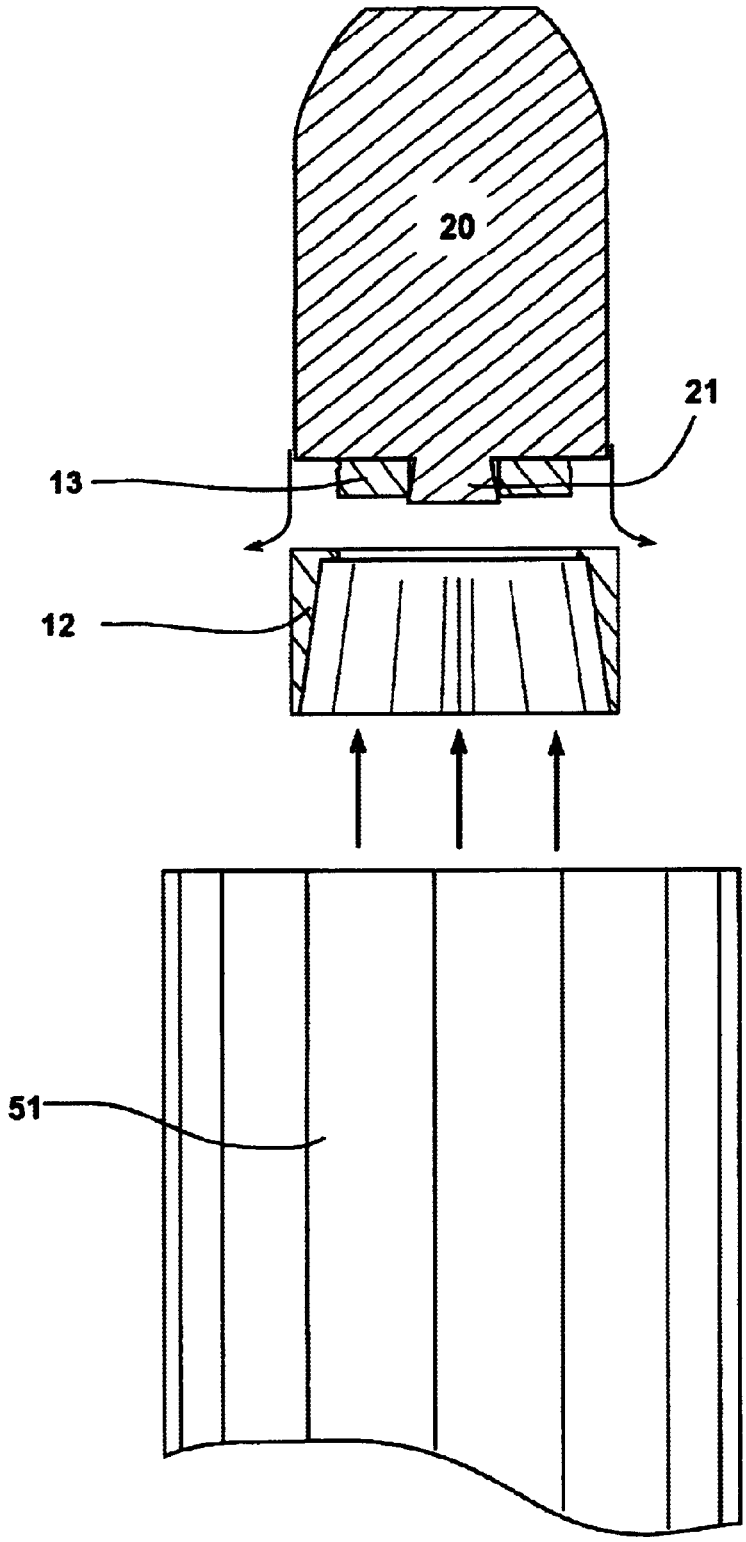
FIG. 5 is a cross-sectional view of the projectile, upon exiting the barrel, showing the basic detachment mechanism of the gas check from the bullet.

Upon firing, the ignition of the powder, and subsequent production of propellant gases facilitates the separation of the bullet from the gas check member. The separation begins at the thin connecting element between the engaging member and the outer member. As shown in FIGS. 2 and 4, an unstable gap 11, of the preferred embodiment is created as a result of the minimal attachment between the inner ring 13 and outer skirt 12 of the gas check member. When the firearm is fired, the rapidly expanding gases propel the projectile 1 forward. The configuration of the gas check allows it to deliver a uniformly distributed force to the bullet to eject it from the barrel, but the thin plastic band 14 is unable to withstand the force of the escaping gases as they rush into the weakened zone 11. The thin band 14 breaks apart and the outer skirt 12 shatters and/or separates from the inner ring 13 and exits the barrel 51, as shown in FIG. 5. After exit from the barrel, shattered fragments of the skirt will travel at a significantly reduced rate of speed relative to the bullet. Therefore, it is expected that such pieces will not disturb the flight of the bullet. The inner ring remains attached rearward of the bullet on its path to the target while the skirt and/or its fragments fall to the ground. The small diameter and light weight of the inner ring allow it to remain attached without compromising the ballistic integrity of the bullet.

In operation, the simplicity of the invented gas check enables users of muzzle-loading firearms to load such weapons quickly and easily. In addition, the gas check improves the ballistic qualities of the shot by minimizing both the escape of essential propellant gases and harmful bullet and bore interactions. Ultimately, the gas check improves the accuracy and effectiveness of muzzle-loading firearms.

Although this invention has been described above with reference to particular means, materials and embodiments, it is to be understood that the invention is not limited to these disclosed particulars, but extends instead to all equivalents within the scope of the following claims.

I claim:

1. An annular gas check for use in muzzle-loading firearms comprising:

an outer wall with diameter exceeding that of the bore of the firearm; and an engaging member, for attaching the gas check to the back of a bullet, which engaging member is joined to said outer wall by an appreciably thin, or weakened, connecting element wherein upon exit from the barrel of said firearm, said outer wall and said engaging member become separated in the region of the thin connecting element.

2. The gas check of claim 1 wherein:

said outer wall engages the rifling of the bore to hold the bullet in place within the barrel, to prevent moisture from the barrel from contacting the powder when in place within the barrel, and to impart spin to the bullet upon firing.

3. The gas check of claim 1 wherein:

the gas check is frictionally attached to the back of said bullet by said engaging member.

4. The gas check of claim 1 wherein:

the check harnesses rapidly expanding gas products of gunpowder ignition to impart a distributed forward thrust to said bullet.

5. The gas check of claim 4 wherein under the thrusting force of said gases said connecting element breaks apart upon exit from the barrel thereby separating said engaging member and outer wall to prevent interference with the ballistic properties of said bullet.

6. An annular gas check for use in muzzle-loading firearms comprising:

an outer wall with diameter exceeding that of the bore of the firearm; and an engaging mechanism substantially surrounded by said outer wall for frictionally attaching to the rearward portion of a bullet wherein said engaging mechanism is connected to said outer wall by a band of material which is appreciably weakened or reduced in thickness relative to the thickness of the engaging mechanism such that upon exit from the barrel said band of material fractures thereby separating said outer wall from said engaging mechanism.

7. The gas check of claim 6 wherein:

said outer wall engages the rifling of the bore to hold the bullet in place within the barrel, to prevent moisture from the barrel from contacting the powder when in place within the barrel, and to impart spin to the bullet upon firing.

8. The gas check of claim 6 wherein:

the gas check is frictionally attached to the back of said bullet by said engaging mechanism.

9. The gas check of claim 6 wherein:

the gas check harnesses rapidly expanding gas products of gunpowder ignition to impart a distributed forward thrust to said bullet.

10. The gas check of claim 9 wherein under the thrusting force of said gases said connecting element breaks apart upon exit from the barrel thereby separating said engaging mechanism and outer wall to prevent interference with the ballistic properties of said bullet.

11. An annular gas check for use in muzzle-loading firearms comprising:

a generally cylindrical outer skirt with diameter slightly exceeding that of the bore of the firearm; and an inner ring for frictionally attaching said gas check to a bullet or similar projectile wherein:

the ring is coaxial with and substantially surrounded by said outer skirt; the ring features an aperture for receiving a short stem protruding from the rear of the bullet along its central axis; and the ring is connected to the outer skirt at its forward end by a band of material which is appreciably weakened or reduced in thickness relative to the thickness of the inner ring such that upon exit from the barrel said band of material fractures thereby separating said outer skirt from said inner ring.

12. The gas check of claim 11 wherein:

said outer skirt engages the rifling of the bore to hold the bullet in place within the barrel, to prevent moisture from the barrel from contacting the powder when in place within the barrel, and to impart spin to the bullet upon firing.

13. The gas check of claim 11 wherein:

said aperture in said inner ring has diameter slightly smaller than the largest diameter of said bullet stem.

14. The gas check of claim 11 wherein:

said aperture tolerates a slight deformation to receive said stem thereby frictionally attaching the gas check to the back of said bullet.

15. The gas check of claim 11 wherein:

the gas check harnesses rapidly expanding gas products of gunpowder ignition to impart a distributed forward thrust to said bullet.

16. The gas check of claim 14 wherein under the thrusting force of said gases said band of material breaks apart upon exit from the barrel thereby separating said inner ring and outer skirt to prevent interference with the ballistic properties of said bullet.

* * * * *